US011033081B2

(12) United States Patent
Myerscough et al.

(10) Patent No.: US 11,033,081 B2
(45) Date of Patent: Jun. 15, 2021

(54) METHOD OF SEALING A ZIPPER CLOSURE AND A SEALED ZIPPER ASSEMBLY

(71) Applicant: YKK (U.S.A.) Inc., Marietta, GA (US)

(72) Inventors: Richard Kerr Myerscough, Victoria (CA); Ross David Harrington, Victoria (CA)

(73) Assignee: YKK (U.S.A.) Inc.

( * ) Notice: Subject to any disclaimer, the term of this patent is extended or adjusted under 35 U.S.C. 154(b) by 0 days.

(21) Appl. No.: 16/734,670

(22) Filed: Jan. 6, 2020

(65) Prior Publication Data

US 2020/0196717 A1 Jun. 25, 2020

Related U.S. Application Data

(63) Continuation-in-part of application No. 16/300,209, filed as application No. PCT/CA2017/050477 on Apr. 18, 2017.

(60) Provisional application No. 62/334,732, filed on May 11, 2016.

(51) Int. Cl.
*A44B 19/32* (2006.01)

(52) U.S. Cl.
CPC ..... *A44B 19/32* (2013.01)

(58) Field of Classification Search
CPC ..... A44B 19/32; A44B 19/36; Y10T 24/2505
See application file for complete search history.

(56) References Cited

U.S. PATENT DOCUMENTS 2,347,583 A 4/1944 Vartabedian
2,454,214 A 11/1948 Sapp
2,615,224 A * 10/1952 Shur ..... A44B 19/32 24/384
2,641,037 A 6/1953 Gossner
2,693,013 A * 11/1954 Gossner ..... A44B 19/32 24/384
2,746,114 A 5/1956 Williams
2,841,851 A 7/1958 Van Amburg et al.
3,102,570 A 9/1963 Fairchilds
5,062,186 A 11/1991 Rampolla et al.
6,092,266 A 7/2000 Lee (Continued)

FOREIGN PATENT DOCUMENTS

CN 103945724 A 7/2014
CN 203748781 U 8/2014

(Continued)

OTHER PUBLICATIONS

European Office Action Corresponding to EP17 795 241.0 dated Jun. 17, 2020.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A method of sealing a zipper closure has a first waterproof element in the form of a sealing zone base and a second waterproof element in the form of a waterproof interlocking zipper fastener. The first waterproof element and the second waterproof element are placed in overlapping engagement to define a sealing zone. One or more sealing elements are placed in the sealing zone to prevent leakage.

20 Claims, 19 Drawing Sheets

(56) References Cited

U.S. PATENT DOCUMENTS

| | | | |
|---|---|---|---|
| 6,223,349 | B1 | 5/2001 | Roiser |
| 2013/0133129 | A1 | 5/2013 | Martin |
| 2016/0021990 | A1 | 1/2016 | Ogura et al. |

FOREIGN PATENT DOCUMENTS

| | | | |
|---|---|---|---|
| EP | 1057424 | A2 | 12/2000 |
| EP | 1 481 601 | A2 | 12/2004 |
| GB | 557 418 | | 11/1943 |
| GB | 2 094 396 | A | 9/1982 |
| WO | 2011127353 | A1 | 10/2011 |

OTHER PUBLICATIONS

International Search Report, PCT Patent Application No. PCT/CA2017/050477, dated Jul. 25, 2017, 4 pages.
Written Opinion, PCT Patent Application No. PCT/CA2017/050477, dated Jul. 25, 2017, 4 pages.
Non-Final Office Action, U.S. Appl. No. 16/300,209, Jul. 24, 2020, 7 pages.
U.S. Appl. No. 16/300,209 , Final Office Action, dated Jan. 8, 2021, 8 pages.
Chinese Patent Application No. 201780035087.8 , Office Action, Dec. 16, 2020, 4 pages.
European Patent Application No. 17795214.0 , Office Action, Jan. 25, 2021, 4 pages.

* cited by examiner

METHOD OF SEALING A ZIPPER CLOSURE AND A SEALED ZIPPER ASSEMBLY

This application is a Continuation In Part of U.S. patent application Ser. No. 16/300,209 filed Nov. 9, 2018.

FIELD

There is described a method of sealing a zipper closure and a sealed zipper assembly that can be used in applications involving liquids or potentially harmful gases.

BACKGROUND

EP Patent specification 1,481,601 (Kallionpaa) titled "Closure for zipper ends", discloses a sealing Mechanism for a zipper closure. However, the sealing mechanism taught by the Kallionpaa reference is not ideal. The sealing mechanism is complicated to use and the material around the sealing mechanism tends to become fatigued, eventually leading to failure. The bulk of the sealing mechanism is uncomfortable to wear in some applications. There is, therefore, a need for an alternative method of sealing a zipper closure and an alternative sealed zipper assembly.

SUMMARY

According to one aspect there is provided a method of sealing a zipper closure. The method involves providing a first waterproof element and a second waterproof element. At least one of the first waterproof element or the second waterproof element is a waterproof interlocking zipper fastener. The waterproof interlocking zipper fastener has a first series of interlocking teeth, a second series of interlocking teeth and at least one slide that slides in a first direction to bring the first series of interlocking teeth and the second series of interlocking teeth into engagement and slides in a second direction to disengage the first series of interlocking teeth and the second series of interlocking teeth. The first waterproof element and the second waterproof element are placed in overlapping engagement to define a sealing zone. One or more sealing elements are placed between the first waterproof element and the second waterproof element in the sealing zone to prevent leakage between the first waterproof element and the second waterproof element when the first series of interlocking teeth and the second series of interlocking teeth of the waterproof interlocking zipper fastener are brought into engagement.

There is described how this teaching can be used to create a seal by using a first zipper segment as the first waterproof element and a second zipper segment as the second waterproof element. There is also described how this teaching can be adapted for a linear zipper by having a sealing zone base as the first waterproof element and a waterproof interlocking zipper fastener as the second waterproof element.

According to another aspect there is provided a sealable zipper closure, that includes a first waterproof element and a second waterproof element. At least one of the first waterproof element or the second waterproof element are a waterproof interlocking zipper fastener. The waterproof interlocking zipper fastener has a first series of interlocking teeth, a second series of interlocking teeth and at least one slide that slides in a first direction to bring the first series of interlocking teeth and the second series of interlocking teeth into engagement and slides in a second direction to disengage the first series of interlocking teeth and the second series of interlocking teeth. The first waterproof element and the second waterproof element are positioned in overlapping engagement to define a sealing zone. One or more sealing elements are positioned between the first waterproof element and the second waterproof element in the sealing zone to prevent leakage between the first waterproof element and the second waterproof element when the first series of interlocking teeth and the second series of interlocking teeth of the waterproof interlocking zipper fastener are brought into engagement.

As described above, the sealable zipper closure can be created by overlapping zipper segments or, for a linear zipper configuration, by using a sealing zone base as the first waterproof element.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A first embodiment of sealed zipper assembly with overlapping zipper segments will now be described with reference to FIG. 1 through FIG. 11. Embodiment variations with overlapping zipper segments will be described with reference to FIG. 12 through FIG. 26.

Embodiment variations with linear zipper assemblies will then be described with reference to FIG. 27 through FIG. 43.

Figure 6:
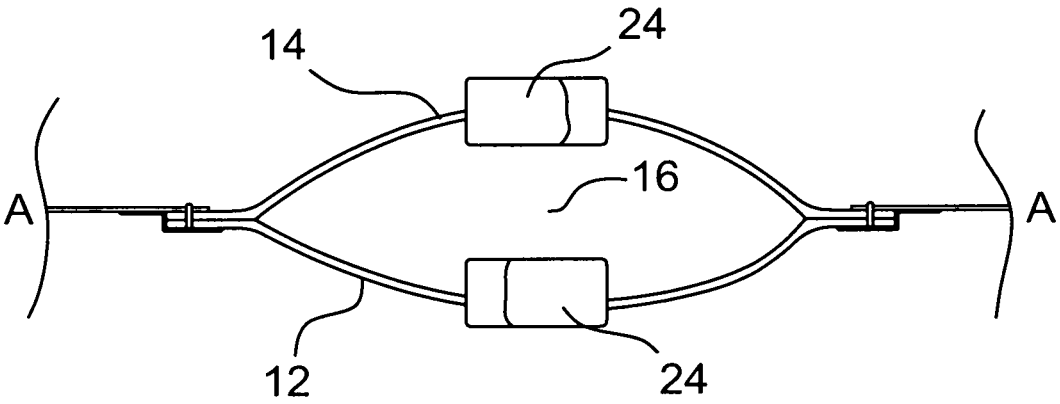
FIG. 6 is a section view of the first embodiment of sealed zipper assembly taken along section lines A-A of FIG. 1.
Figure 9:
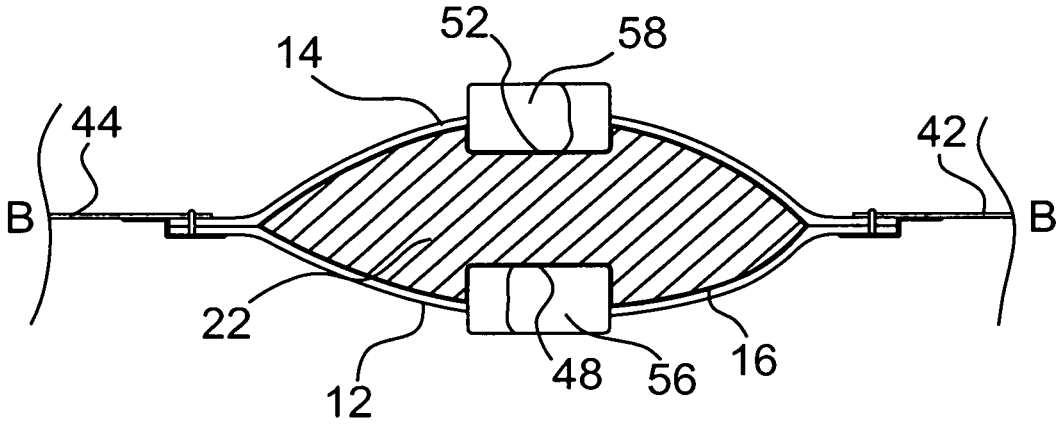
FIG. 9 is a section view of the first embodiment of sealed zipper assembly taken along section lines B-B of FIG. 8.
Figure 10:
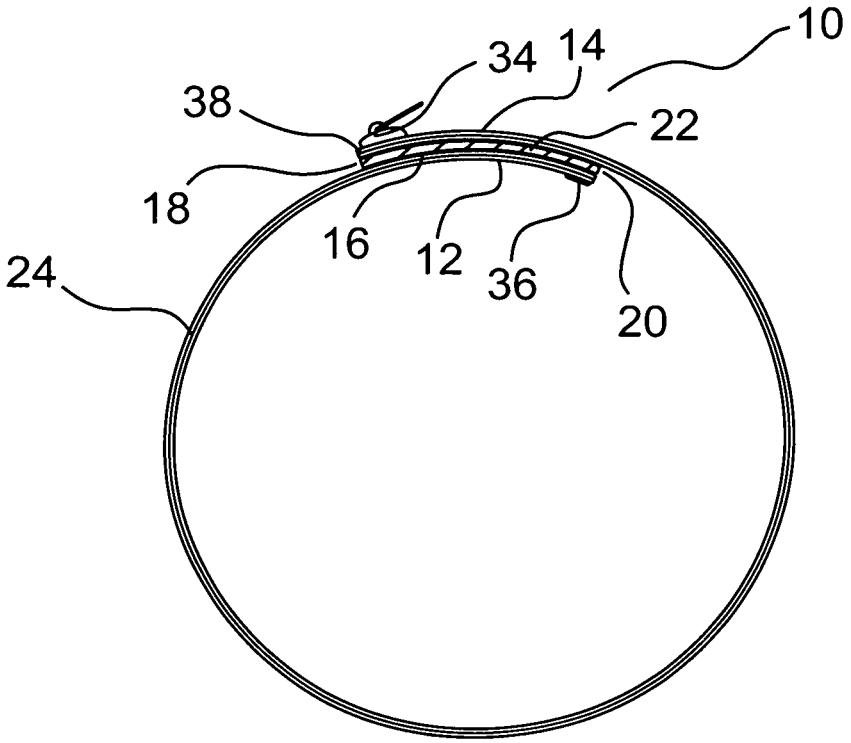
FIG. 10 is a top plan view of the first embodiment of sealed zipper assembly illustrated in FIG. 8.
Figure 11:
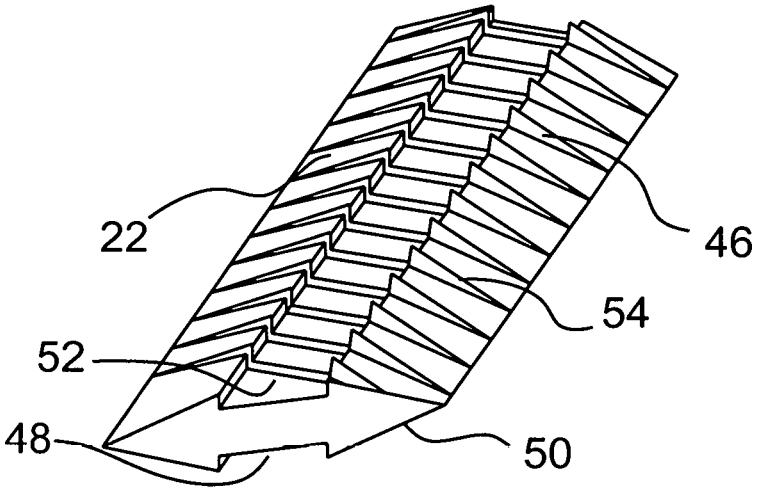
FIG. 11 is a perspective view of a sealing element illustrated in FIG. 9

Structure and Relationship of Parts:

Referring to FIG. 10, first embodiment 10 of sealed zipper assembly includes a first zipper segment 12 and a second zipper segment 14 in overlapping relation to create a sealing zone 16. Referring to FIG. 6 and FIG. 9, sealing zone 16 can be viewed as forming a tunnel. Referring to FIG. 10, in this regard, sealing zone 16 has an exterior opening 18 and an interior opening 20. Referring to FIG. 9 and FIG. 10, a sealing element 22 is positioned in sealing zone 16 to prevent leakage between first zipper segment 12 and second zipper segment 14. Referring to FIG. 11, sealing element 22 is illustrated. Referring to FIG. 9 and FIG. 10, sealing element 22 is resiliently deformable and is compressed within sealing zone 16 by first zipper segment 12 and second zipper segment 14. Referring to FIG. 10, it will be noted that with first embodiment 10 first zipper segment 12 and second zipper segment 14 are part of a single interlocking zipper fastener 24 and create a single sealing zone, previously identified as sealing zone 16. As will hereinafter be illustrated and described with reference to embodiment variations there can be more than one interlocking zipper fastener and more than one sealing zone.

Figure 7:
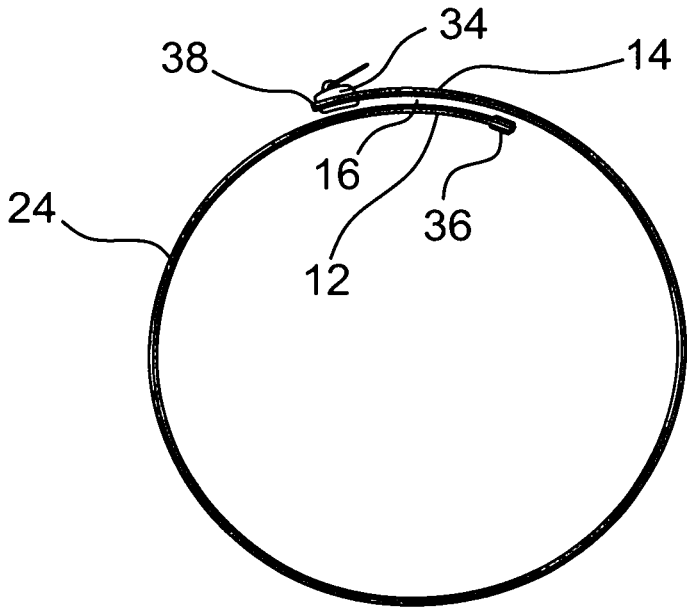
FIG. 7 is a top plan view of the first embodiment of sealed zipper assembly illustrated in FIG. 1.

Referring to FIG. 1 through FIG. 5 and FIG. 8, interlocking zipper fastener 24 having a first series of interlocking teeth 26 supported on a band 28 and a second series of interlocking teeth 30 supported on a band 32. At least one slider 34 is provided. Referring to FIG. 7 and FIG. 10, interlocking zipper fastener 24 has a first end 36 that serves as first zipper segment 12 and a second end 38 that serves as second zipper segment 14 in this embodiment.

Figure 2:
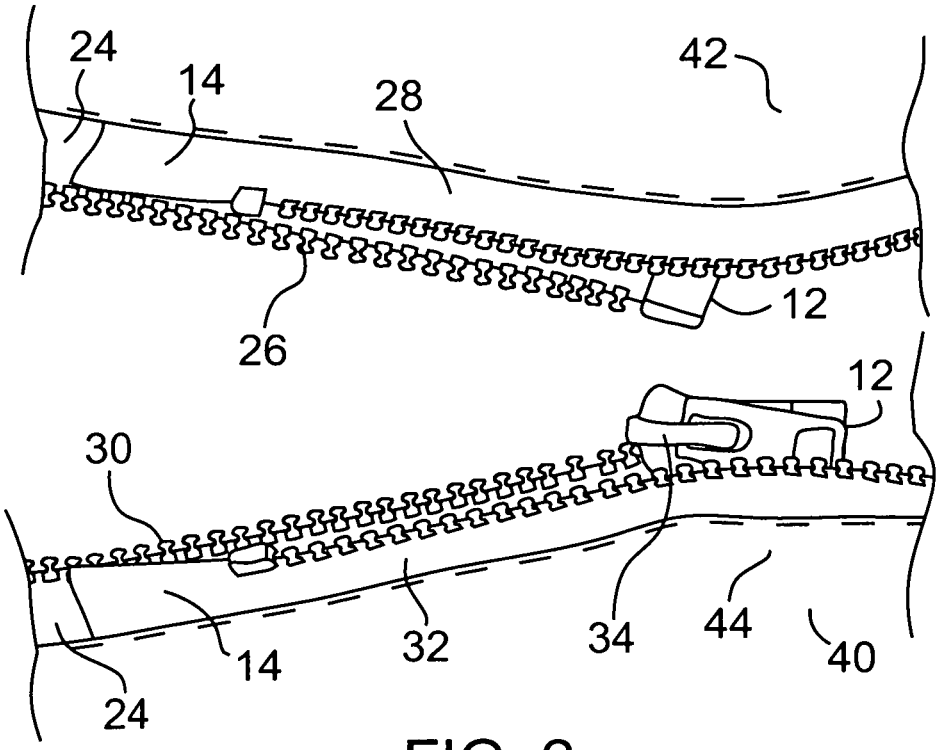
FIG. 2 is a front elevation view of the first embodiment of sealed zipper assembly illustrated in FIG. 1, in an open position.

Referring to FIG. 2, a garment body 40 made with waterproof fabric consists of a first or upper discrete body component 42 and a second or lower discrete body component 44. Interlocking zipper fastener 24 is in a circular configuration that enables first discrete body component 42 to be separated from second discrete body component 44. Referring to FIG. 2, band 28 supporting first series of interlocking teeth 26 constituting a first half of interlocking zipper fastener 24 is secured to first discrete body component 42 in a generally circular configuration to form a first half of first zipper segment 12 and a first half of second zipper segment 14 in overlapping relation. Similarly, band 32 supporting second series of interlocking teeth 30 constituting a second half of interlocking zipper fastener 24 is secured to second discrete body 44 component in a generally circular configuration to form a second half of the first zipper segment 12 and a second half of the second zipper segment 14 in overlapping relation.

Figure 1:
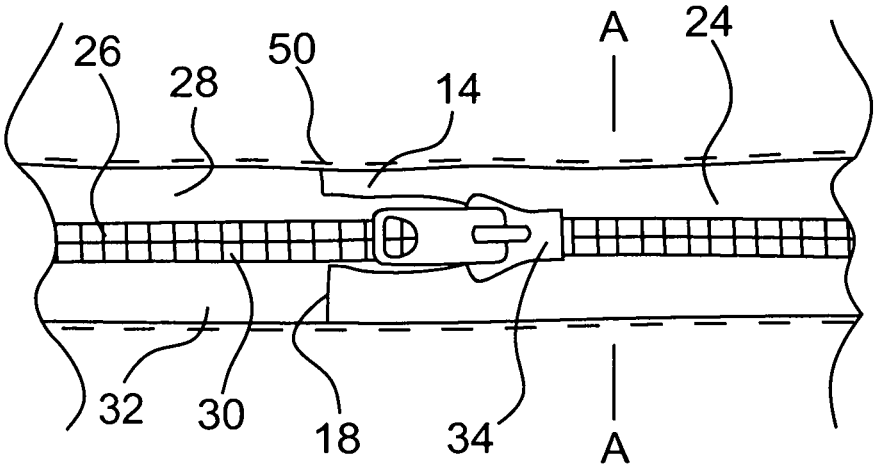
FIG. 1 is a front elevation view of a first embodiment of sealed zipper assembly in a closed position.
Figure 3:
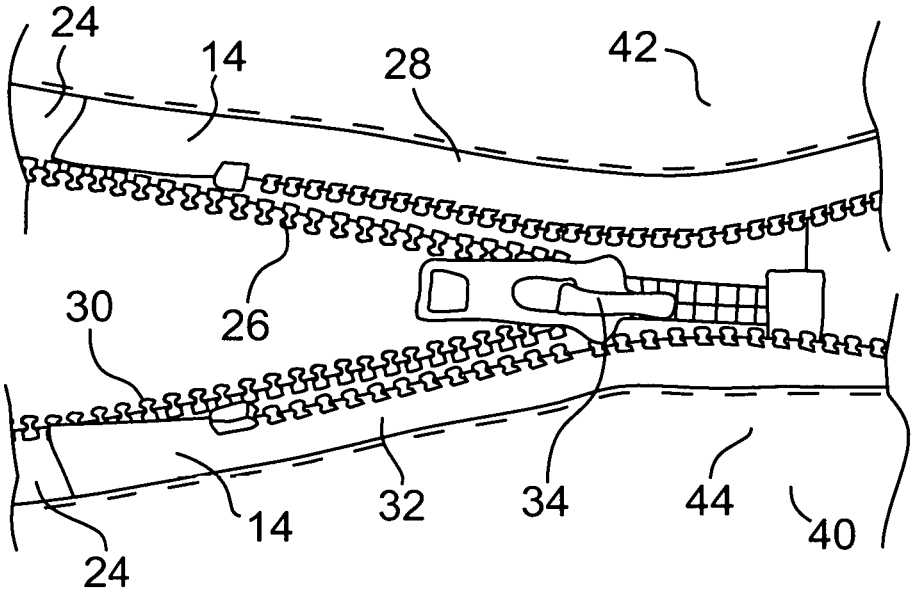
FIG. 3 is a front elevation view of the first embodiment of sealed zipper assembly illustrated in FIG. 1, in a slider starting position.
Figure 4:
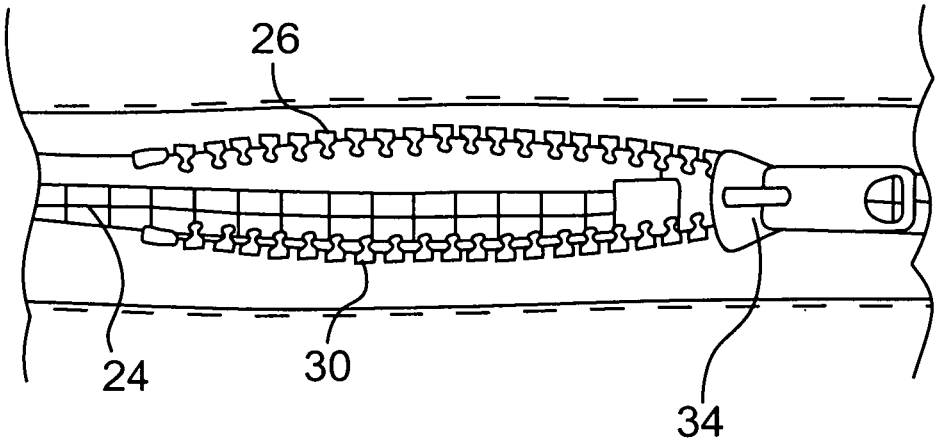
FIG. 4 is a front elevation view of the first embodiment of sealed zipper assembly illustrated in FIG. 1, in a slider closing position.
Figure 8:
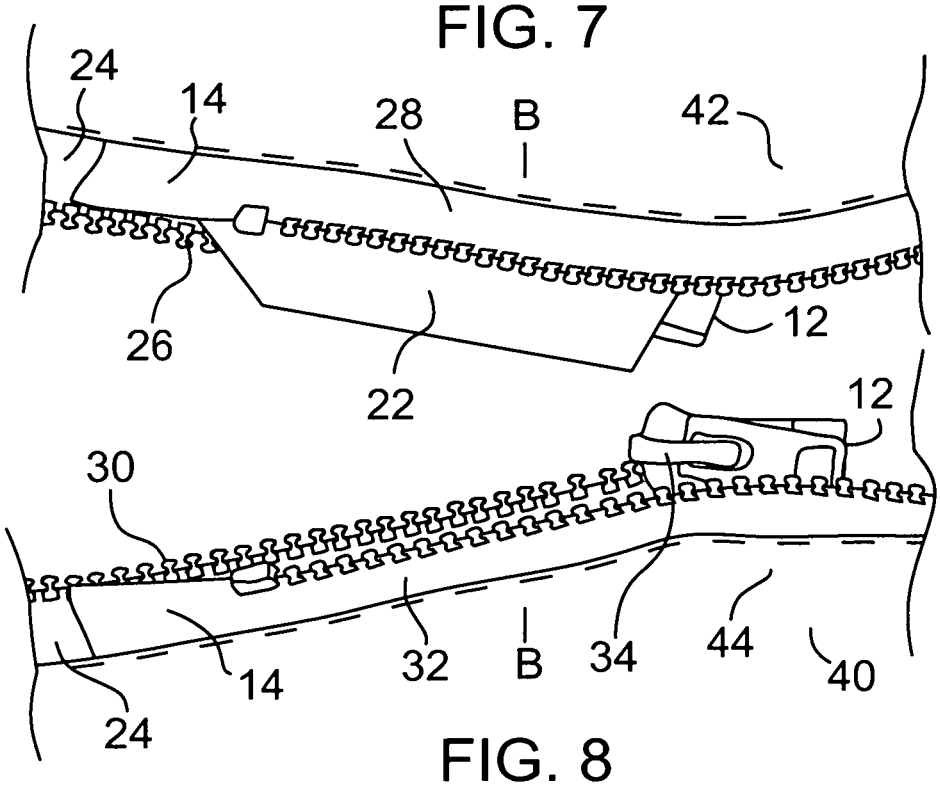
FIG. 8 is a front elevation view of the first embodiment of sealed zipper assembly illustrated in FIG. 1, in an open position with a sealing element.

Referring to FIG. 3, slider 34 is used to slides along interlocking zipper fastener 24 in a first direction to bring first series of interlocking teeth 26 and second series of interlocking teeth 30 into engagement as illustrated in FIG. 1. Referring to FIG. 4, slider 34 slides along interlocking zipper fastener 24 in a second direction to disengage first series of interlocking teeth 26 and second series of interlocking teeth 30 to disengage interlocking zipper fastener 24, as illustrated in FIG. 2. Referring to FIG. 6, FIG. 7, FIG. 9 and FIG. 10, as slider 34 interlocks first series of interlocking teeth 26 and second series of interlocking teeth 30, it completes first zipper segment 12 and second zipper segment 14, the overlapping of which creates sealing zone 16. Sealing zone 16 is then ready to receive sealing element 22. Referring to FIG. 8, sealing element 22 has ridges 46 that assist in sealing. Sealing element 22 also has a first channel 48 on a first face 50 and a second channel 52 on a second face 54. Referring to FIG. 9, First channel 48 receives interlocked teeth 56 of first zipper segment 12 and second channel 52 receives interlocked teeth 58 of second zipper segment 14.

Operation:

Referring to FIG. 2, band 28 supporting first series of interlocking teeth 26 constituting a first half of interlocking zipper fastener 24 is secured to first discrete body component 42 in a generally circular configuration to form a first half of first zipper segment 12 and a first half of second zipper segment 14 in overlapping relation. Band 32 supporting second series of interlocking teeth 30 constituting a second half of interlocking zipper fastener 24 is secured to second discrete body 44 component in a generally circular configuration to form a second half of the first zipper segment 12 and a second half of the second zipper segment 14 in overlapping relation. Referring to FIG. 3, slider 34 slides along interlocking zipper fastener 24 in a first direction to bring first series of interlocking teeth 26 and second series of interlocking teeth 30 into engagement as illustrated in FIG. 1. Referring to FIG. 6 and FIG. 7, as slider 34 interlocks first series of interlocking teeth 26 and second series of interlocking teeth 30, it completes first zipper segment 12 and second zipper segment 14 the overlapping of which creates sealing zone 16. FIG. 9 and FIG. 10, sealing element 22 is compressed within sealing zone 16 by first zipper segment 12 and second zipper segment 14.

Variations:

There will hereinafter be described variations that may be made to the first embodiment. With each variation, elements that are identical to the first embodiment will be identified by identical reference numerals. Only those aspects that differ from the first embodiment will be described.

Figure 12:
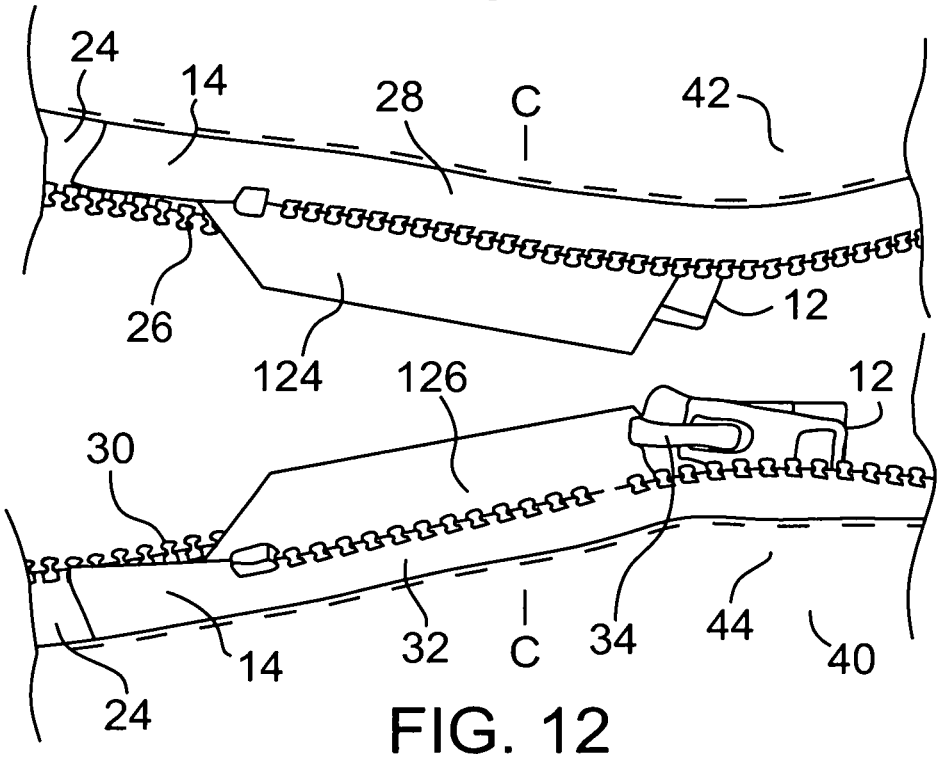
FIG. 12 is a front elevation view of a second embodiment of sealed zipper assembly in an open position.
Figure 13:
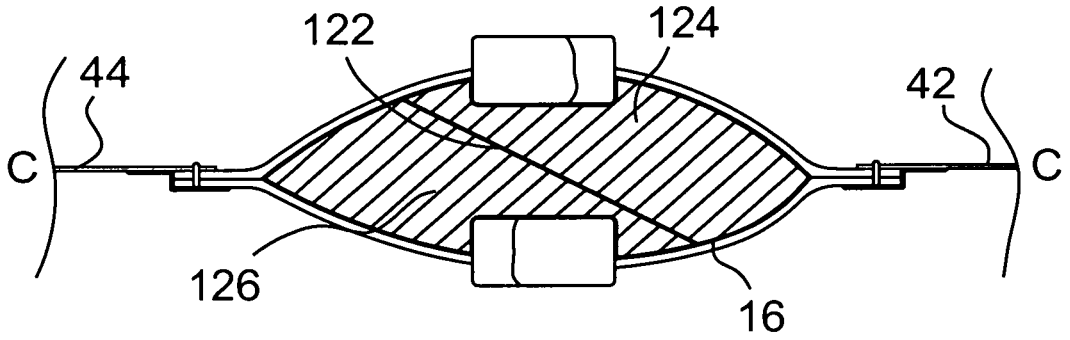
FIG. 13 is a section view of the second embodiment of sealed zipper assembly taken along section lines C-C of FIG. 12.
Figure 14:
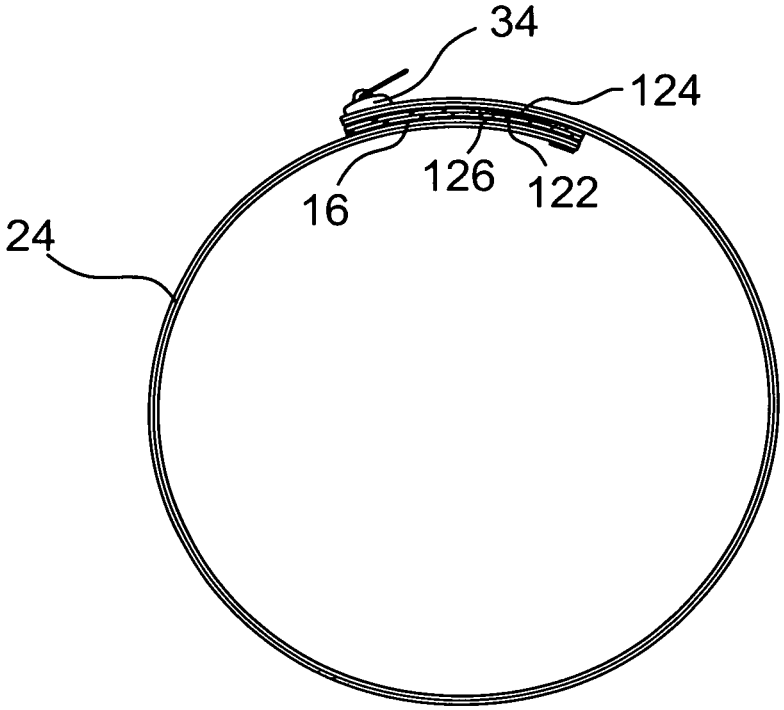
FIG. 14 is a top plan view of the second embodiment of sealed zipper assembly illustrated in FIG. 12.
Figure 15:
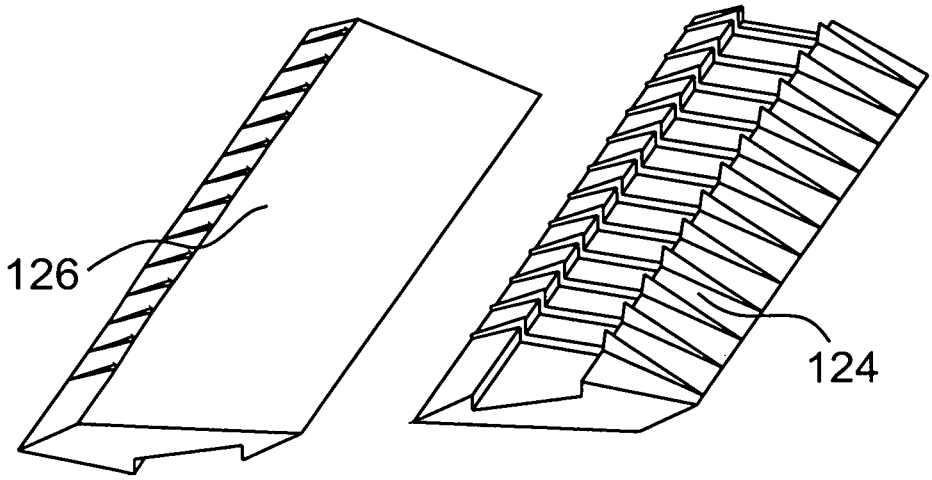
FIG. 15 is an exploded perspective view of a sealing element illustrated in FIG. 13.

The first embodiment illustrated a single sealing element 22. Referring to FIG. 15, there is illustrated an alternative sealing element 122 that has a first seal component 124 and a second seal component 126. Referring to FIG. 12, first seal component 124 is wedged into and held by friction or otherwise secured to first discrete body component 42. Second seal component 126 is wedged into and held by friction or otherwise secured to second discrete body component 44. Referring to FIG. 13 and FIG. 14, when interlocking zipper fastener 24 is closed, first seal component 124 and second seal component 126 are forced together to form sealing element 122 which fills sealing zone 16.

Figure 16:
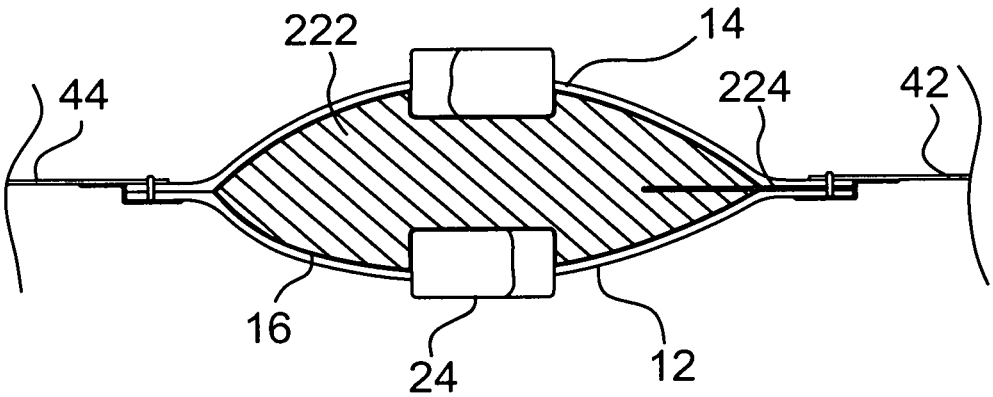
FIG. 16 is a section view of a third embodiment of sealed zipper assembly.
Figure 17:
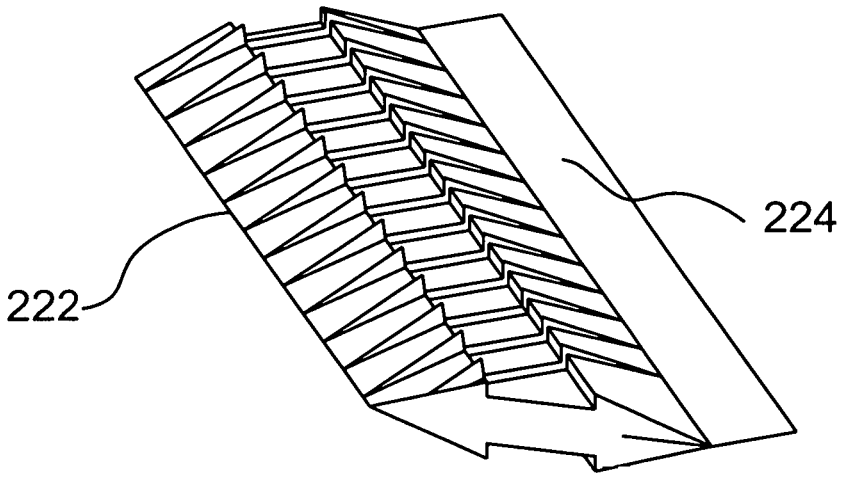
FIG. 17 is a perspective view of a sealing element illustrated in FIG. 16.

In the first embodiment, sealing element 22 was held in place by friction and was removable. Referring to FIG. 16 and FIG. 17, alternative sealing element 222 has a fabric strip 224 moulded into the elastomeric foam. Fabric strip 224 is used to secure alternative sealing element 222 to first discrete body component 42. This is done by stitching through fabric strip 224. Fabric strip 224 serves to anchor alternative sealing element 222 to first discrete body component 42 in a desired position where sealing zone 16 is formed by the overlapping of first zipper segment 12 and second zipper segment 14 of interlocking zipper fastener 24. It will be appreciated that there are other ways to secure alternative sealing element within sealing zone 16.

Figure 18:
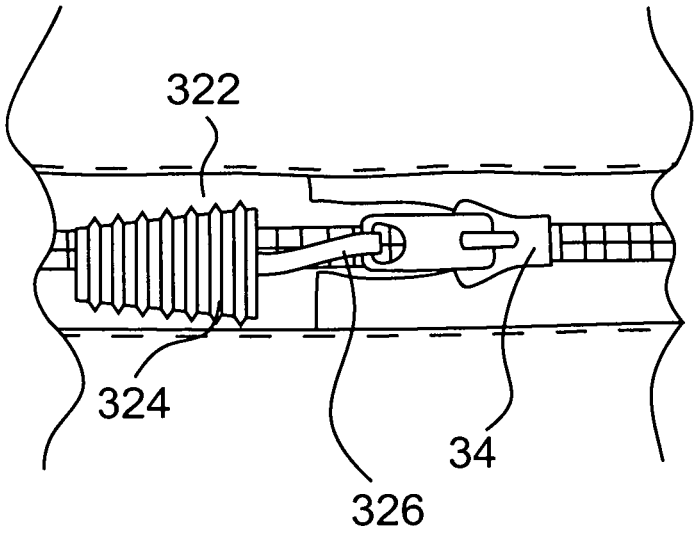
FIG. 18 is a front elevation view of a fourth embodiment of sealed zipper assembly in a closed position, prior to sealing.
Figure 19:
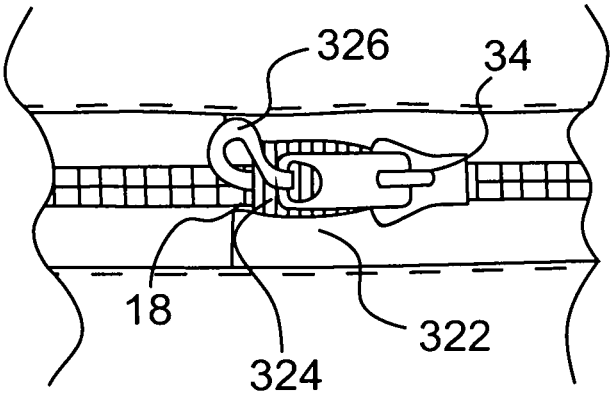
FIG. 19 is a front elevation view of the fourth embodiment of sealed zipper assembly illustrated in FIG. 18, with sealing element inserted into the sealing zone.

In the first embodiment, sealing element 22 was elastomeric foam. Referring to FIG. 18 and FIG. 19 an alternative sealing element 322 is illustrated. Referring to FIG. 18, sealing element 322 is a plug 324 that is suspended by a tether 326 from slider 34 when not in use. Referring to FIG. 19, plug 324 is intended to be inserted into exterior opening 18 of sealing zone 16 to seal sealing zone 16. It is preferred that plug 324 have a surface profile, such as ribs or ridges, to enhance both the sealing capacity and the holding capacity of plug 324. It will be appreciated that there are other raised surface profiles that would similarly serve this purpose.

Figure 22:
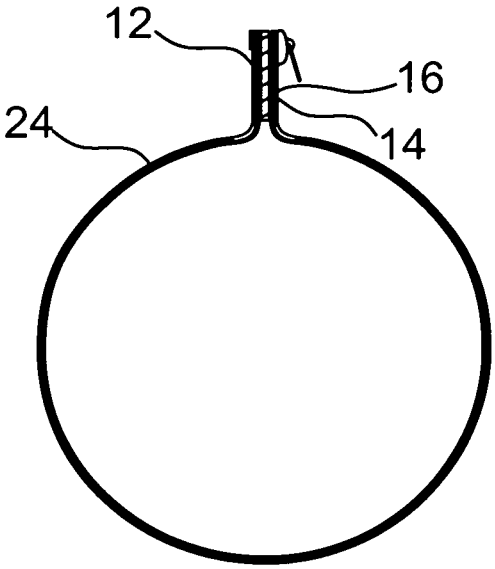
FIG. 22 is a top plan view of a seventh embodiment of sealed zipper assembly.

In the first embodiment, first zipper segment 12 and second zipper segment 14 are positioned substantially parallel to interlocking zipper fastener 24. Referring to FIG. 22, first zipper segment 12 and second zipper segment 14 which form sealing zone 16, can be configured so that they project outwardly or radially from interlocking zipper fastener 24.

Figure 23:
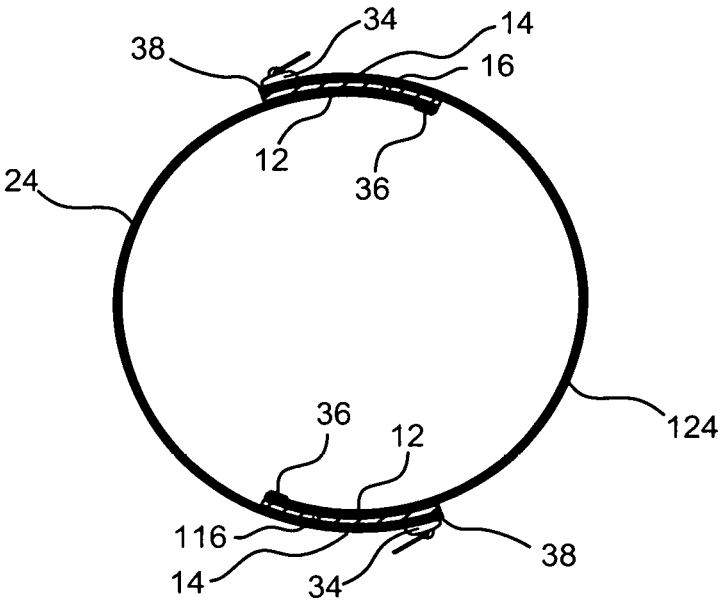
FIG. 23 is a top plan view of an eighth embodiment of sealed zipper assembly.

In the first embodiment, there was only one interlocking zipper fastener 24 and only one sealing zone 16. Referring to FIG. 23, there is shown a configuration that has more than one interlocking zipper fastener 24 and more than one sealing zone 16. With this configuration, first end 36 of one interlocking zipper fastener 24 serves as first zipper segment 12 and second end 38 of another interlocking zipper fastener 124 serves as second zipper segment 14 to create a first sealing zone 16. In addition, first end 36 of interlocking zipper fastener 124 serves as first zipper segment 12 and second end 38 of interlocking zipper fastener 24 serves as second zipper segment 14 to create a second sealing zone 116. It will be appreciated that although two interlocking zipper fasteners 24 and 124 have been illustrated in a circular configuration more than two interlocking zipper fastener could also be arranged in a circular configuration in a like manner.

Figure 24:
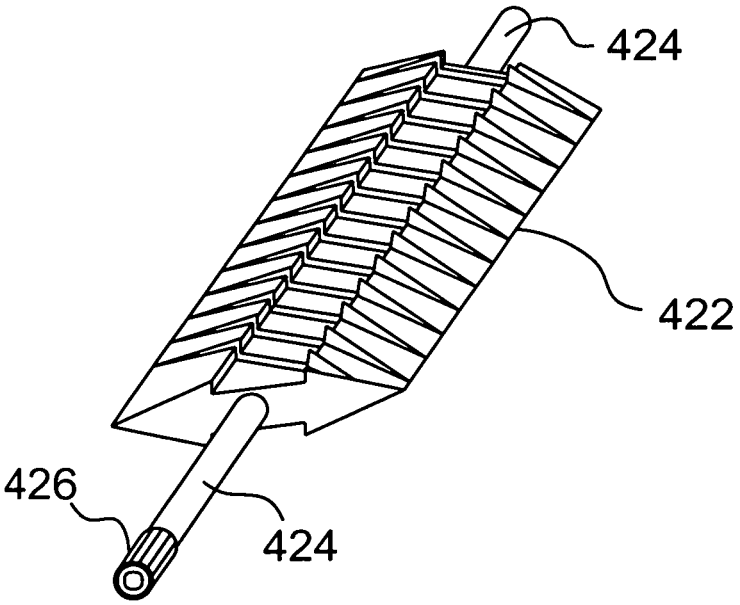
FIG. 24 is a perspective view of an alternative sealing element having an air transfer tube.

It is not unusual for a garment intended for use in water, such as garment body 40 to have air transfer valves, to provide for air movement. Referring to FIG. 24, alternative sealing element 422 is shown with an air transfer tube 424 extending through the body of alternative sealing element 422. Air transfer tube 424 allows for movement of air in and out of garment body 40. When garment body 40 is to be submerged in water or another liquid, a closure valve 426 can be used to close air transfer tube 424.

Figure 25:
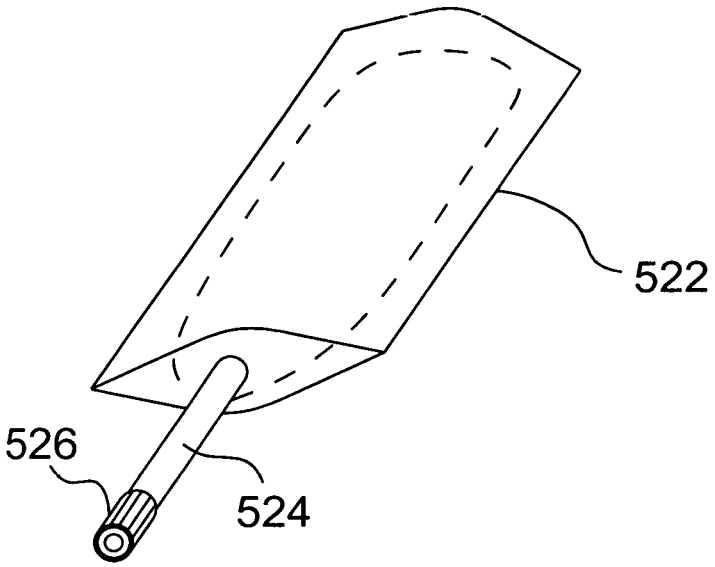
FIG. 25 is a perspective view of an inflatable sealing element.

In the first embodiment, sealing element 22 was compressed. Referring to FIG. 25, a bladder like alternative sealing element 522 is shown which is expandable like a balloon. Alternative sealing element 522 has a tube 524 into which a user may blow to inflate alternative sealing element 522 and a closure valve 526 that is to maintain air pressure within alternative sealing element 522. When expanded, alternative sealing element 522 expands to occupy sealing zone 16.

Figure 26:
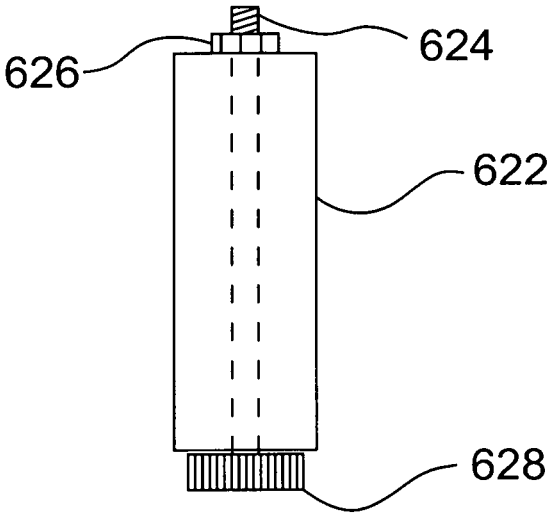
FIG. 26 is a front elevation view of an alternative sealing element that is compressible in a lengthwise direction.

Another alternative sealing element is positioned between two clamping elements with at least one of the clamping elements being movable toward and away from another of the clamping elements. As the clamping elements are moving closer together, the sealing element is forced outwardly to seal the sealing zone. Referring to FIG. 26, one such clamping configuration is illustrated. Alternative sealing element 622 has a bolt 624 that runs through it lengthwise. There is a nut 626 on one end of the bolt 624 and a twist knob 628 on the other end of bolt 624. Nut 626 serves as one clamping element and twist knob 626 serves as another clamping element. Turning twist knob 628 causes axial movement that compresses alternative sealing element 622 between twist knob 628 and nut 626. When compressed, alternative sealing element 622 expands outwardly increasing the circumference of alternative sealing element 622 until alternative sealing element 622 seals the sealing zone.

Advantages:

The method of sealing a zipper closure and the sealed zipper assemblies described above provide a number of advantages:

1. It is relatively simple to use, when compared with the Kallionpaa reference.

2. It is less expensive to manufacture, when compared with the Kallionpaa reference.

3. It has less bulk and is more comfortable to wear, when compared with the Kallionpaa reference.

4. It has greater flex and is less subject to material fatigue, when compared with the Kallionpaa reference.

5. It will work with any most, if not all, brands and styles of dry zipper.

6. It has a degree of adjustability to fit difference circumferences by increasing or decreasing the amount of overlap, whereas the Kallionpaa reference is an endless loop that must be made to a specific circumference.

7. If air transfer is desired, an air transfer tube can be positioned through the sealing element to avoid making extra holes in garment 40 to accommodate air transfer valves.

Cautionary Warnings:

It will be appreciated that not all zippers can function in a liquid environment. In order to avoid leakage, one has to use a waterproof zipper. It will also be appreciated that there are a number of different styles of waterproof zippers. Suitable waterproof zippers will be known to persons familiar with underwater diving and will, therefore, not be listed here.

In order for the sealing elements described above to be effective, there are a number of leakage points along stitches and seams that must be effectively sealed.

Figure 5:
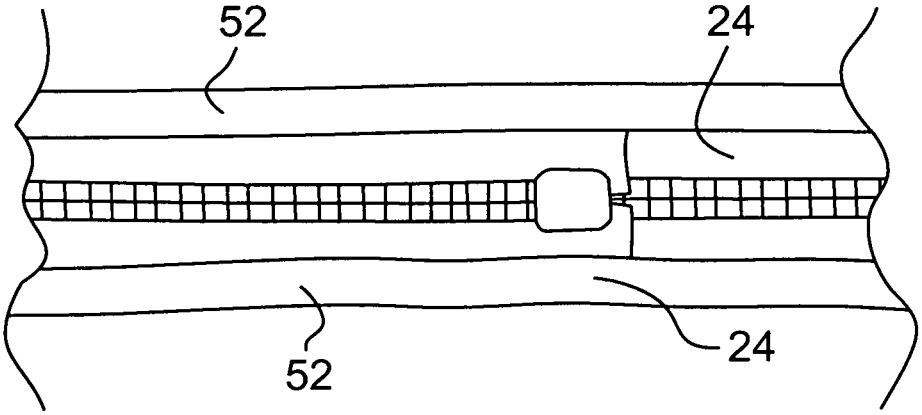
FIG. 5 is a rear elevation view of the first embodiment of sealed zipper assembly illustrated in FIG. 1, in a closed position.

Referring to FIG. 1, stitches 50 are used to secure interlocking zipper fastener 24 in place. Referring to FIG. 5, waterproof tape 52 is heat sealed or secured by adhesive to reverse side of stitches 50 to prevent liquids weeping through stitches 50.

Figure 20:
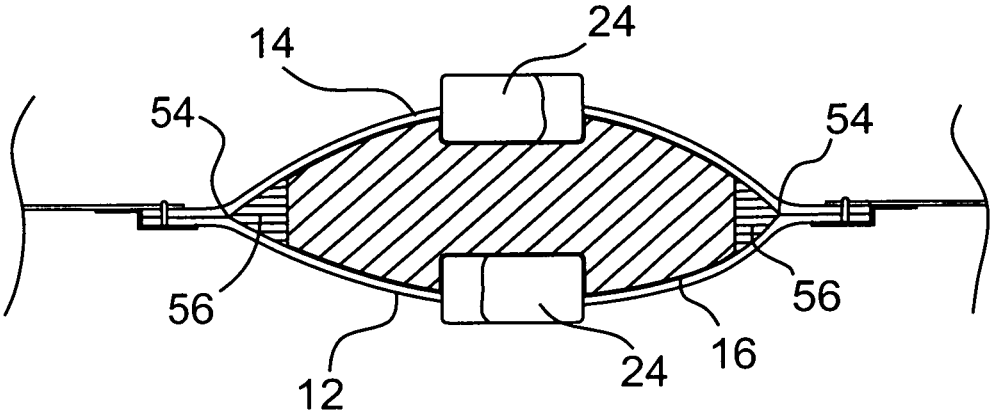
FIG. 20 is a section view of a fifth embodiment of sealed zipper assembly.
Figure 21:
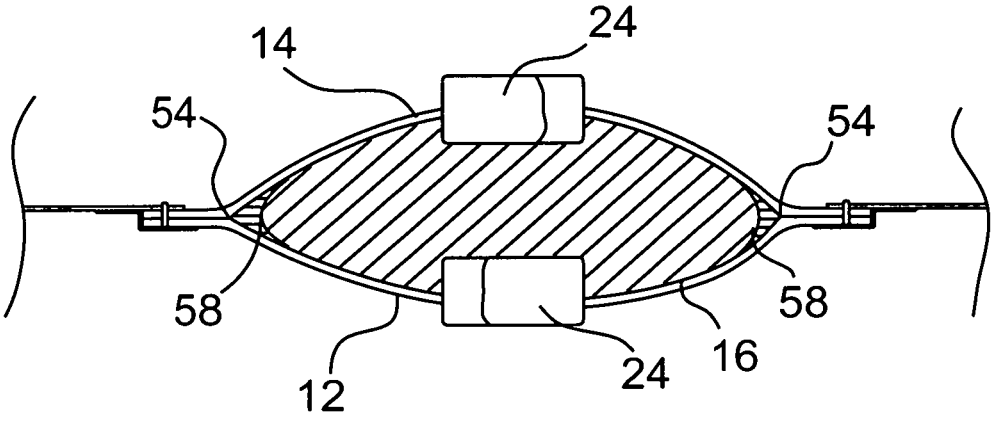
FIG. 21 is a section view of a sixth embodiment of sealed zipper assembly.

Referring to FIG. 20 and FIG. 21, sealing zone 16 has edge seams 54 that are subject to leakage. Referring to FIG. 20, leakage can be addressed by sealing edge seams 54 with pliable edge moulding 56. Referring to FIG. 21, leakage can also be addressed by sealing edge seams 54 by using a bead 58 of polymer caulking compound.

Linear Zipper Assemblies

Having successfully created an effective sealed zipper assembly using overlapping zipper segments, a challenge remained as to how to seal linear zipper assemblies. There are only a limited number of applications in which zipper assemblies overlap. However, there are numerous applications in which it is desirable for a waterproof garment to have a linear zipper assembly that is sealed.

It was reasoned that in the circular application the first zipper segment provided a first waterproof element and the second zipper segment provided a second waterproof element. A sealing zone was created by placing the first waterproof element and the second waterproof element in overlapping engagement. One or more sealing elements could then be positioned in the sealing zone to prevent leakage between the first waterproof element and the second waterproof element.

The question then arose as to whether one of the zipper segments could be replaced by a different form of waterproof element. Experiments were conducted using a sealing zone base as the first waterproof element. This experiment was successful. It was determined that correct seal positioning could best be maintained by mounting one or more sealing elements to the sealing zone base. Where more than one sealing zone was desired, it was determined that this could be created by having more than one sealing zone base positioned in spaced relation with one or more sealing element mounted on each sealing zone base.

The sealing zone base can take a number of forms. It can be a sheet of waterproof material. It can be a molded component with a sealing element built it. It can be a molded component with a sealing element secured to it. It can be anything that, when combined with a sealing element is capable of making a seal to prevent water entry.

There follows a figure by figure description of the practical application of these teachings.

Figure 27:
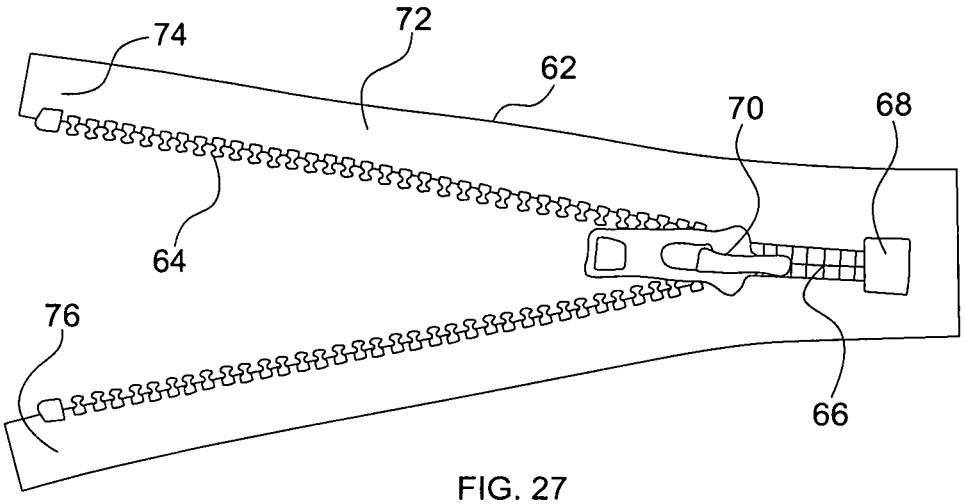
FIG. 27 is a front elevation view of a linear zipper assembly, in an open position.

FIG. 27 is a front elevation view of a one end closed dry zipper 62 in an open position. One end closed dry zipper 62 has a closed end termination 68 that is waterproof, interlocking teeth 64 disposed along band 72, a first open end 74 of band 72 and a second open end 76 of band 72, a slider 70 and interlocked teeth 66 that exist between the slider 70 and closed end termination 68.

Figure 28:
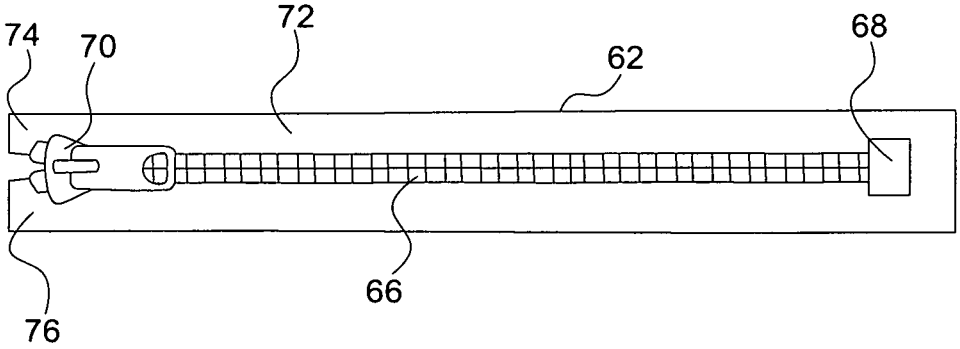
FIG. 28 is a front elevation view of the linear zipper assembly of FIG. 27, in a closed position.

FIG. 28 is a front elevation view of a one end closed dry zipper 62 in a closed position. Slider 70 is pulled so that first open end 74 of band 72 and a second open end 76 of band 72 are drawn together and there are interlocked teeth 66 that exist between the slider 70 and closed end termination 68.

Figure 29:
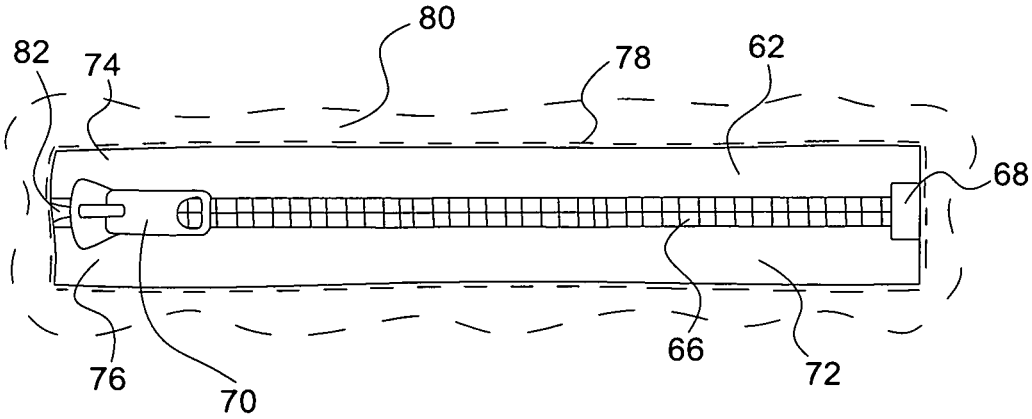
FIG. 29 is a front elevation view of the linear zipper assembly of FIG. 28, incorporated into a waterproof garment.

FIG. 29 is a front elevation view of a one end closed dry zipper 62, attached to an opening in waterproof fabric 80 by stitching 78, in a closed position. First open end 74 of band 72 and a second open end 76 of band 72 are drawn together by slider 70 leaving a non-waterproof opening 82. Interlocked teeth 66 between the slider 70 and closed end termination 68 are waterproof.

Figure 30:
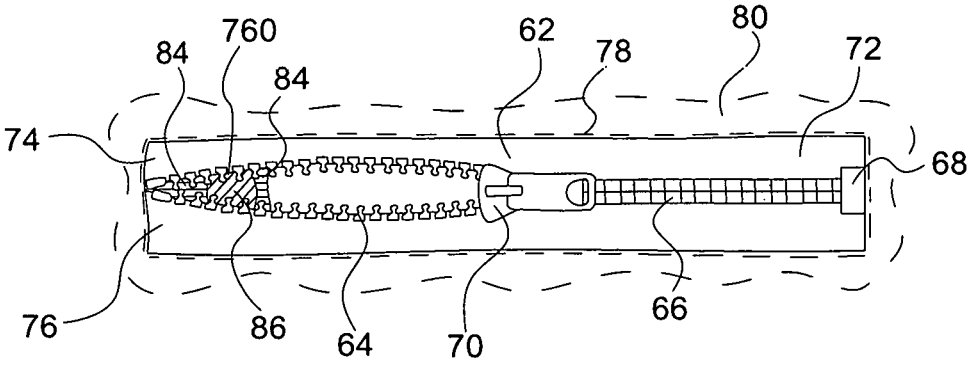
FIG. 30 is a front elevation view of the linear zipper assembly of FIG. 27, with the addition of a sealing element positioned on a sealing zone base.

FIG. 30 is a front elevation view of a one end closed dry zipper 62, attached to an opening in waterproof fabric 80 by stitching 78, in a semi closed position. Under open end 74 of band 72 and a second open end 76 of band 72 is the first embodiment 760 of the invention that consists of a sealing element 86 that is held in place by sealing zone base 84, in the form a waterproof sealing zone base.

Figure 31:
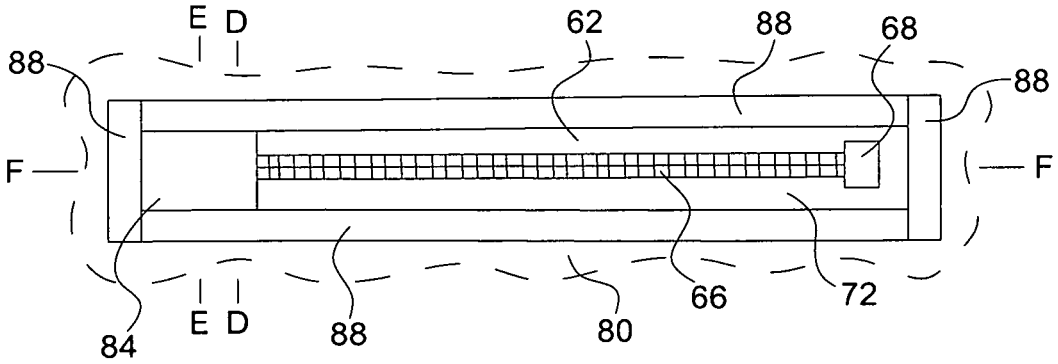
FIG. 31 is a rear elevation view of the linear zipper assembly of FIG. 30.

FIG. 31 is a rear elevation view of a one end closed dry zipper 62, attached to an opening in waterproof fabric 80, in a closed position with the sealing zone base 84 at the end opposite to the closed end termination 68. Waterproof tape 88 seals the band 72, of the one end closed dry zipper 62, and the sealing zone base 84 to the opening in the waterproof fabric 80.

Figure 32:
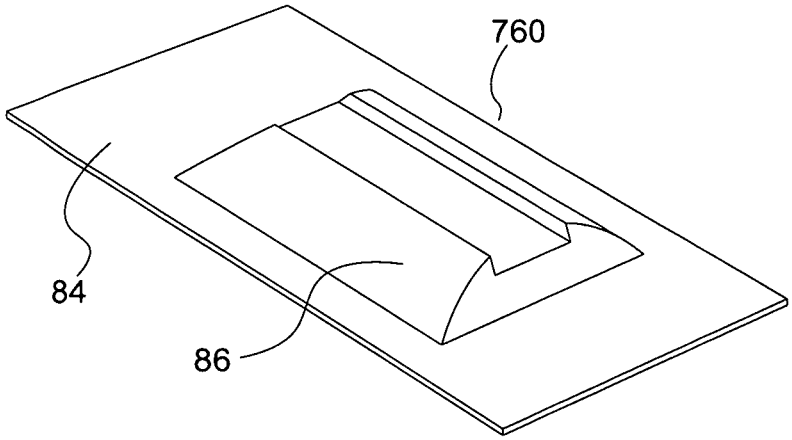
FIG. 32 is a perspective view of the sealing element positioned on a sealing zone base of FIG. 30.

FIG. 32 is a perspective view of the first embodiment 760 showing the sealing element 86 mounted to the sealing zone base 84 thus creating a waterproof connection between them.

Figure 33:
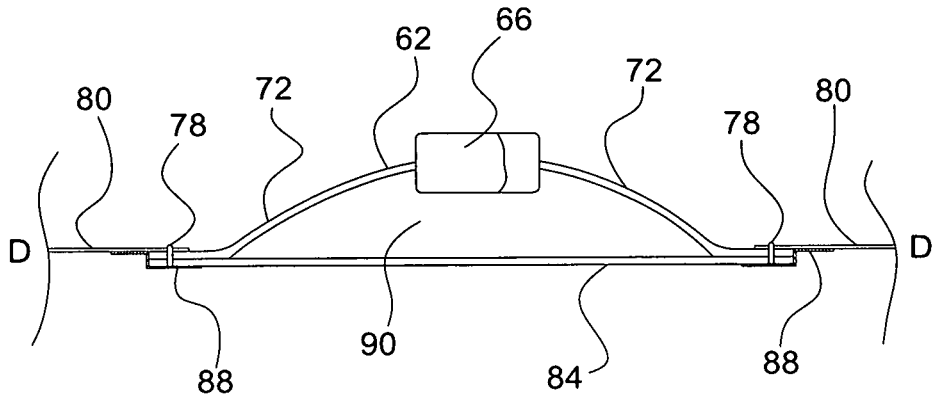
FIG. 33 is a section view taken along section lines D-D of FIG. 31.

FIG. 33 is a section view taken along line D-D of FIG. 31 showing how the band 72, of a one end closed dry zipper 62, interlocked teeth 66 and sealing zone base 84 are joined together forming a sealing zone 90, which is connected to waterproof fabric 80 by stitching 78, and made waterproof by sealing with waterproof tape 88.

Figure 34:
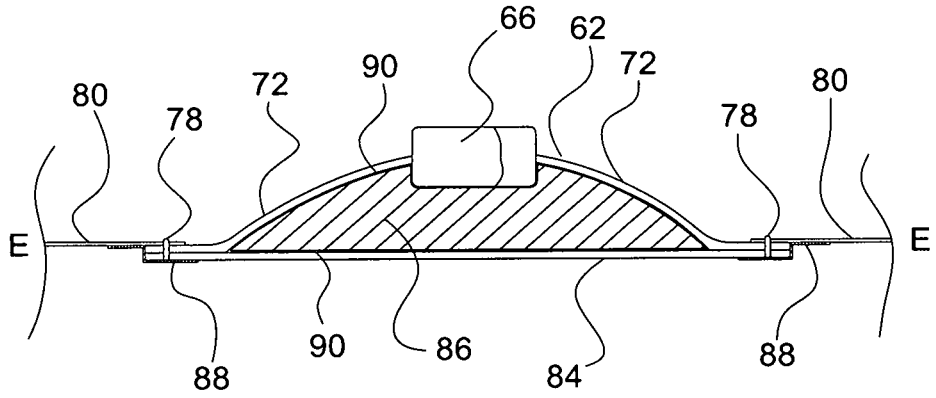
FIG. 34 is a section view taken along section lines E-E of FIG. 31.

FIG. 34 is a section view taken along line E-E of FIG. 31 showing how the sealing zone 90 is sealed in a waterproof manner by sealing element 86 that binds against bands 72 and interlocking teeth 66 of the one end closed dry zipper 62.

Figure 35:
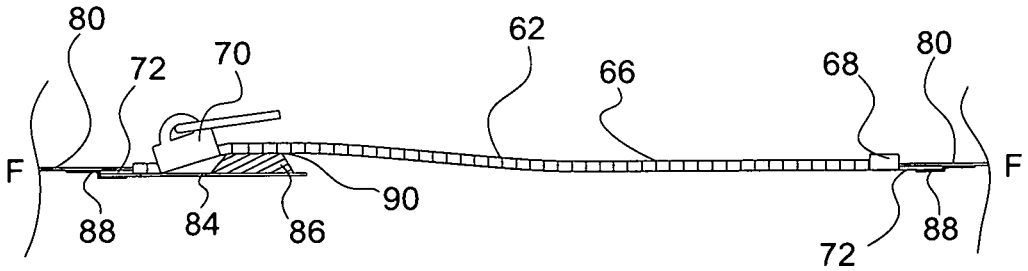
FIG. 35 is a section view taken along section lines F-F of FIG. 31.

FIG. 35 is a section view taken along line F-F of FIG. 31 showing the one end closed dry zipper 62 in a closed position and how, at the end opposite to the closed end termination 68, the sealing zone 90 is sealed in a waterproof manner by sealing element 86, that binds against interlocking teeth 66 of the one end closed dry zipper 62, and the sealing element 86 is held in place by sealing zone base 84 that is connected to the waterproof fabric 80 and band 72 and made waterproof by sealing with waterproof tape 88.

Figure 36:
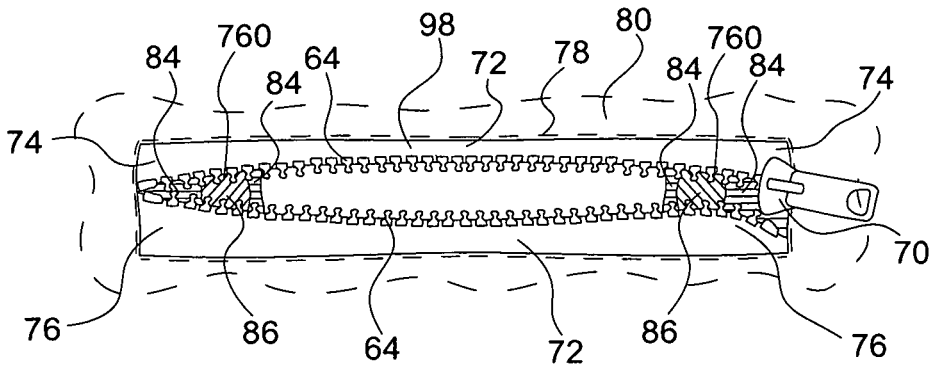
FIG. 36 is a front elevation view of the linear zipper assembly of FIG. 27, with the addition of dual sealing elements each sealing element positioned on a sealing zone base.

FIG. 36 is a front elevation view of a both ends open dry zipper 98, attached to an opening in waterproof fabric 80 by stitching 78, in an open position showing how first embodiment 760, consisting of sealing element 86 mounted to the sealing zone base 84, can be used at both ends of a both ends open dry zipper 98 to allow for a waterproof seal.

Figure 37:
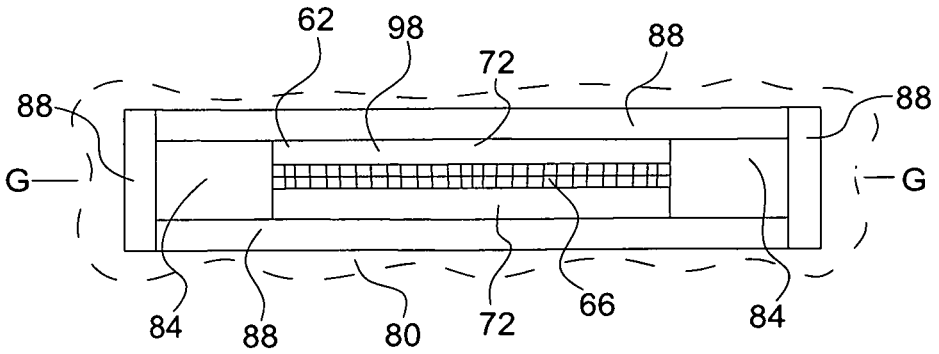
FIG. 37 is a rear elevation view of the linear zipper assembly of FIG. 36.

FIG. 37 is a rear elevation view of a both ends open dry zipper 98, attached to an opening in waterproof fabric 80, in a closed position with sealing zone bases 84 at either end. Waterproof tape 88 seals the bands 72, of the both ends open dry zipper 98, and the sealing zone bases 84 to the opening in the waterproof fabric 80.

Figure 38:
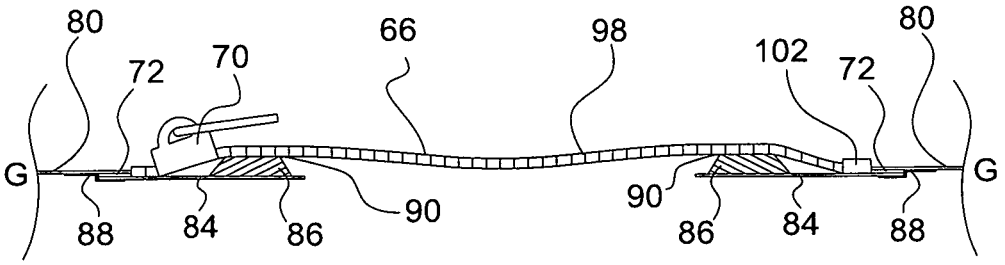
FIG. 38 is a section view taken along section lines G-G of FIG. 37.

FIG. 38 is a section view taken along line G-G of FIG. 37 showing the both end open dry zipper 98 in a closed position and how the sealing zones 90 are sealed in a waterproof manner, by sealing elements 86 that bind against interlocking teeth 66, at either end of the both ends open dry zipper 98 and the sealing elements 86 are held in place by sealing zone bases 84 that are connected to the waterproof fabric 80 and bands 72 and made waterproof by sealing with waterproof tape 88.

Figure 39:
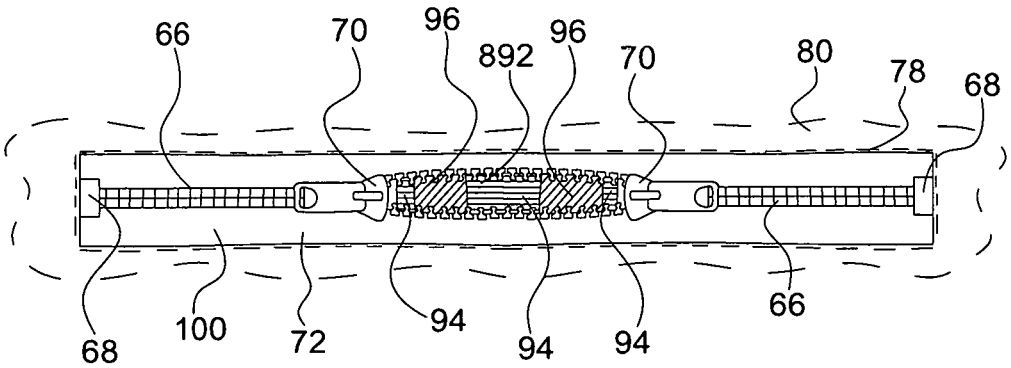
FIG. 39 is a front elevation view of the linear zipper assembly of FIG. 27, with the addition of dual sealing elements positioned on a common sealing zone base.

FIG. 39 is a front elevation view of a both ends closed dry zipper 100 with two sliders 70 in a partial opened position, attached to an opening in waterproof fabric 80 by stitching 78, showing how the second embodiment 892 can be used to make a waterproof seal where the two sliders 70 meet. Second embodiment 892 consists of two sealing elements 96 that are held in place by a sealing zone base 94.

Figure 40:
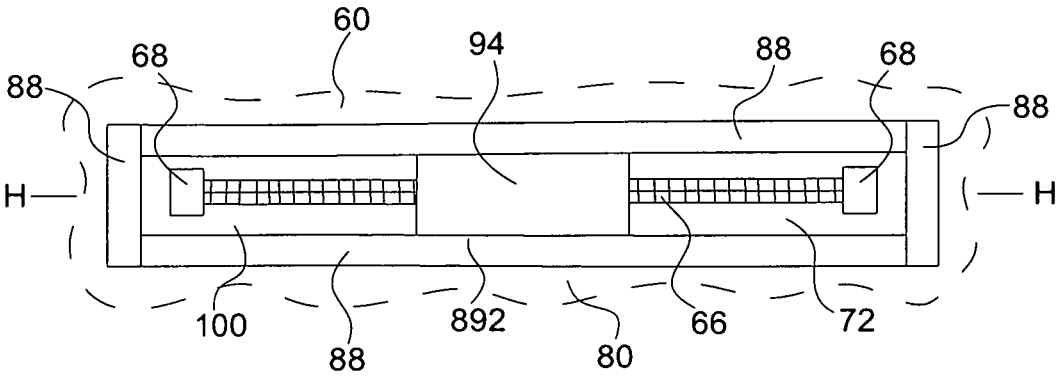
FIG. 40 is a rear elevation view of the linear zipper assembly of FIG. 39.

FIG. 40 is a rear elevation view of a both ends closed dry zipper 100, attached to an opening in waterproof fabric 80, in a closed position with a sealing zone base 94 positioned where the two sliders 70 meet. Waterproof tape 88 seals the bands 72, of the both ends closed dry zipper 100, and the sealing zone base 94 to the opening in the waterproof fabric 80.

Figure 41:
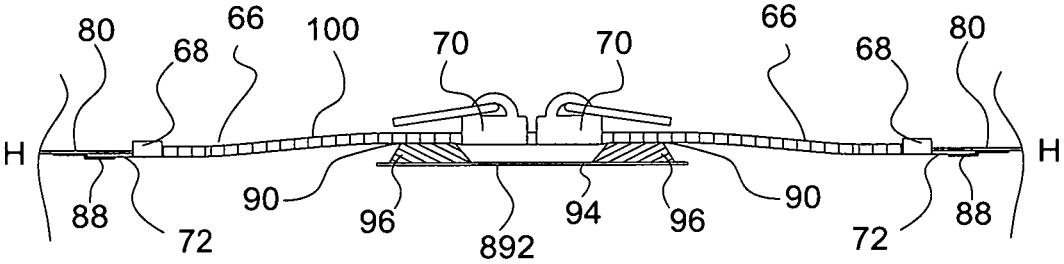
FIG. 41 is a section view taken along section lines H-H of FIG. 37.

FIG. 41 is a section view taken along line H-H of FIG. 40 showing the both end closed dry zipper 100 in a closed position and how the sealing zones 90 are sealed in a waterproof manner, by sealing elements 96 that bind against interlocking teeth 66, where the two sliders 70 meet and the sealing elements 96 are held in place by the sealing zone base 94.

Figure 42:
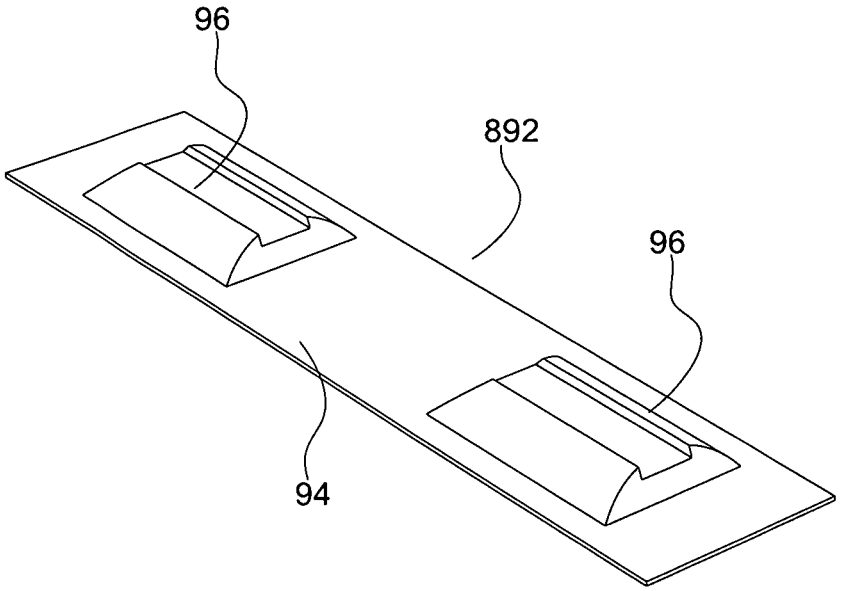
FIG. 42 is a perspective view of the dual sealing elements positioned on the common sealing zone base of FIG. 41.

FIG. 42 is a perspective view of the second embodiment 892 showing the sealing elements 96 mounted to the sealing zone base 94 thus creating a waterproof connection between them.

Figure 43:
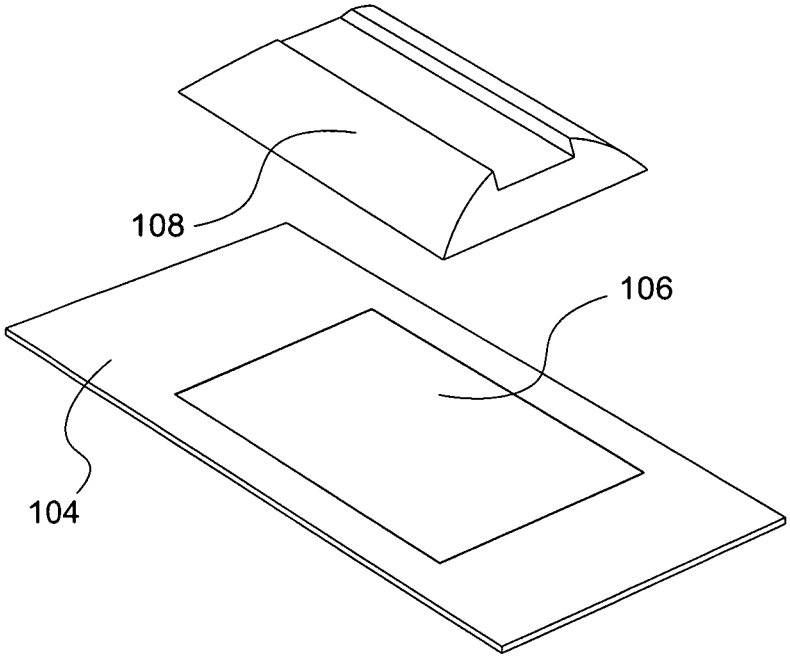
FIG. 43 is a perspective view of one manner of mounting sealing elements to a sealing zone base.

FIG. 43 is a perspective view showing an alternative construction where the sealing element 108 can be a separate piece that connects to an area 106 on a separate sealing zone base 104.

Advantages to Above Described the Linear Zipper Assemblies

The length of a linear dry zipper can be easily adjusted and still be fully waterproof. Existing dry zippers that are closed on both ends only come in set sizes, other sizes must be custom ordered which has high MOQ and cost. It is relatively easy to close the dry zipper and get a waterproof seal. Existing dry zippers that are closed on both ends require the slider to be docked into a fitting at the end of the dry zipper and if the slider isn't fully docked then it will leak. There's a tactile feeling of the slider going over the sealing element so it's easy to tell if the dry zipper is waterproof when closing. The cost to manufacture is lower than existing both ends closed dry zippers. The method will work with any type of dry zipper (brass, plastic, zip lock, teeth, coil etc.). The sealing method is less damaging to the zipper as it's a flexible seal rather than a hard seal. The sealing method allows zippers of otherwise good quality that have poor quality sealed ends to be sealed properly. The sealing method can be used with one end closed dry zippers, both ends closed dry zippers, both ends open dry zipper, dry zippers that have been cut to length (sold on a roll). There can be multiple zones along a zipper that can open or close.

There are various aspects and refinements that can be made in the construction of the sealed zipper assembly. The sealing zone base can be connected to the dry zipper by the stitching that holds the zipper to the waterproof material and then these stitches sealed with waterproof tape. The sealing zone base can be welded to the dry zipper. The sealing element can be moulded directly onto the sealing zone base. The sealing element can be mechanically joined to the sealing zone base, so that the sealing elements are replaceable. The sealing element can be glued with adhesive to the sealing zone base. There are a variety of materials that can be used for the sealing element, such as flexible rubbers, plastics, and polymers. External ridges or textures can be placed on the sealing element to aid in sealing.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The illustrated embodiments have been set forth only as examples and should not be taken as limiting a purposive interpretation of the claims.

What is claimed is:

1. A method of sealing a zipper closure, comprising:

placing a first waterproof element and a second waterproof element in an overlapping relation to define a sealing zone, wherein at least one of the first waterproof element or the second waterproof element comprises a waterproof interlocking zipper fastener, wherein the waterproof interlocking zipper fastener comprises a first series of interlocking teeth, a second series of interlocking teeth and at least one slide, and wherein the at least one slide slides in a first direction to bring the first series of interlocking teeth and the second series of interlocking teeth into engagement and slides in a second direction to disengage the first series of interlocking teeth and the second series of interlocking teeth; and positioning at least one sealing element between the first waterproof element and the second waterproof element and in the sealing zone to prevent leakage between the first waterproof element and the second waterproof element when the first series of interlocking teeth and the second series of interlocking teeth of the waterproof interlocking zipper fastener are brought into engagement, wherein the at least one sealing element is removable from the sealing zone.

2. The method of claim 1, wherein the first waterproof element is the waterproof interlocking zipper fastener and the second waterproof element is the waterproof interlocking zipper fastener.

3. The method of claim 1, wherein the first waterproof element is a sealing zone base and the second waterproof element is the waterproof interlocking zipper fastener.

4. The method of claim 3, wherein the at least one sealing element is mounted to the sealing zone base.

5. The method of claim 4, wherein there is more than one sealing element mounted to the sealing zone base.

6. The method of claim 3, wherein there is more than one sealing zone base positioned in spaced relation, at least one sealing element being mounted on each sealing zone base.

7. The method of claim 1, wherein the at least one sealing element is a resiliently deformable sealing element that is compressed within the sealing zone.

8. A method of sealing a zipper closure, comprising:

placing a first waterproof element and a second waterproof element in overlapping relation to define a sealing zone, wherein the first waterproof element comprises at least one sealing zone base, wherein the second waterproof element comprises a waterproof interlocking zipper fastener comprising a first series of interlocking teeth, a second series of interlocking teeth and at least one slide, and wherein the at least one slide slides in a first direction to bring the first series of interlocking teeth and the second series of interlocking teeth into engagement and slides in a second direction to disengage the first series of interlocking teeth and the second series of interlocking teeth; and positioning at least one sealing element between the first waterproof element and the second waterproof element and in the sealing zone by inserting the at least one sealing element along a length direction into an opening formed by the overlapping first waterproof element and second waterproof element to prevent leakage between the first waterproof element and the second waterproof element when the first series of interlocking teeth and the second series of interlocking teeth of the waterproof interlocking zipper fastener are brought into engagement.

9. The method of claim 8, wherein the at least one sealing element is mounted to the sealing zone base.

10. The method of claim 9, wherein there is more than one sealing element mounted to the sealing zone base.

11. The method of claim 8, wherein there is more than one sealing zone base positioned in spaced relation, with one or more sealing element mounted on each sealing zone base.

12. The method of claim 8, wherein the at least one sealing element is a resiliently deformable sealing element that is compressed within the at least one sealing zone.

13. A sealable zipper closure, comprising:

a first waterproof element;

a second waterproof element; and at least one sealing element, wherein at least one of the first waterproof element or the second waterproof element comprises a waterproof interlocking zipper fastener, the waterproof interlocking zipper fastener comprising a first series of interlocking teeth, a second series of interlocking teeth, and at least one slide, and wherein the at least one slide is slidable in a first direction to bring the first series of interlocking teeth and the second series of interlocking teeth into engagement and in a second direction to disengage the first series of interlocking teeth and the second series of interlocking teeth, wherein the first waterproof element and the second waterproof element are positionable in an overlapping relation to define a sealing zone, wherein the at least one sealing element is positionable between the first waterproof element and the second waterproof element and in the sealing zone to prevent leakage between the first waterproof element and the second waterproof element when the first series of interlocking teeth and the second series of interlocking teeth of the waterproof interlocking zipper fastener are brought into engagement, and wherein the at least one sealing element is removable from the sealing zone.

14. The sealable zipper closure of claim 13, wherein the first waterproof element is a sealing zone base and the second waterproof element is the waterproof interlocking zipper fastener.

15. The sealable zipper closure of claim 13, further comprising a tether attached to the at least one sealing element.

16. The sealable zipper closure of claim 13, further comprising an edge moulding between the first waterproof element and the second waterproof element such that the edge moulding is positionable within the sealing zone, wherein the edge moulding is configured to engage the at least one sealing element in the sealing zone.

17. The sealable zipper closure of claim 16, wherein the edge moulding is pliable.

18. The sealable zipper closure of claim 16, wherein the edge moulding is configured to seal an edge seam of the sealing zone.

19. The sealable zipper closure of claim 16, wherein the edge moulding is a first edge moulding, and wherein the sealable zipper closure further comprises a second edge moulding opposite from the first edge moulding and between the first waterproof element and the second waterproof element.

20. The sealable zipper closure of claim 13, wherein the sealing zone comprises an exterior opening and an interior opening arranged in a length direction, and wherein the at least one sealing element is removable from and insertable into the sealing zone through the exterior opening.

* * * * *